US008104207B2

(12) United States Patent
Pitcher et al.

(10) Patent No.: US 8,104,207 B2
(45) Date of Patent: Jan. 31, 2012

(54) HIGH CEILING SIGN HANGING ARRANGEMENT

(75) Inventors: David E. Pitcher, Swampscott, MA (US); Thomas P. Burrous, Haverhill, MA (US); Rebecca C. Suciu, Lynn, MA (US); Alan L. Stenfors, Scituate, MA (US); Sidney Rose, Marblehead, MA (US)

(73) Assignee: Rose Displays, Ltd., Salem, MA (US)

( * ) Notice: Subject to any disclaimer, the term of this patent is extended or adjusted under 35 U.S.C. 154(b) by 57 days.

(21) Appl. No.: 12/590,091

(22) Filed: Nov. 2, 2009

(65) Prior Publication Data

US 2011/0099866 A1 May 5, 2011

(51) Int. Cl.
*G09F 7/22* (2006.01)

(52) U.S. Cl. ..... 40/617; 40/601; 248/489; 248/323; 294/209

(58) Field of Classification Search ..... 40/617, 40/601; 248/492, 494, 495, 323, 328; 294/22, 294/24

See application file for complete search history.

(56) References Cited

U.S. PATENT DOCUMENTS

| | | | | |
|---|---|---|---|---|
| 357,312 | A * | 2/1887 | Fowler | 294/24 |
| 5,409,191 | A * | 4/1995 | Wenmaekers | 248/317 |
| 5,794,906 | A * | 8/1998 | Harris et al. | 248/317 |
| 6,048,010 | A * | 4/2000 | Stocker | 294/19.1 |
| 7,237,351 | B1 * | 7/2007 | Fehring | 40/611.01 |
| 7,287,738 | B2 * | 10/2007 | Pitlor | 248/544 |
| 2008/0203748 | A1 * | 8/2008 | Suciu et al. | 294/19.1 |
| 2009/0320339 | A1 * | 12/2009 | Burrous et al. | 40/479 |

* cited by examiner

*Primary Examiner* — Joanne Silbermann
*Assistant Examiner* — Kristina N Junge
(74) *Attorney, Agent, or Firm* — Don Halgren

(57) ABSTRACT

A high ceiling sign hanging arrangement for enabling the attachment and removal of a suspended sign from an extended height, comprising: an elongated upper rail having an upper channel therein for receipt of a ceiling attachment member, the upper rail having an upper rail support cleat, for receipt of a sign bearing anchor rail; an elongated anchor rail for bearing a sign therefrom, the anchor rail comprising an anchor cleat on an upper edge thereon; and a lift means comprising a main flange for mating with the anchor rail and subsequent dis-engagement from the anchor rail upon deposit of the anchor rail on the upper rail support cleat of the upper rail.

5 Claims, 7 Drawing Sheets

HIGH CEILING SIGN HANGING ARRANGEMENT

BACKGROUND OF THE INVENTION

1. Field of the Invention

The present invention relates to systems for enabling the attachment and removal of signs relative to securement rails fastened onto high ceilings in commercial retail establishments.

2. Prior Art

Retail stores and commercial establishments have been hanging signs from their ceilings for a long time. However, there are commercial establishments where the ceilings may be relatively high and difficult to reach. When it is desired to support a sign from a ceiling in that type of establishment, It was typically necessary to hang signs from cables that are strung from the ceiling itself. Changing signs there would require cutting and reinstalling cables. This would be a very expensive and time-consuming method for changing advertising display signs. It may also involve using tall ladders or expensive lift systems to lift employees to an undesirable height within that store.

It is an object of the present invention to provide a sign display system which overcomes the disadvantages of the prior art.

It is a further object of the present invention, to provide a display system which utilizes a one time installation of an upper support rail, to allow for easy sign changing and direct placement onto a location anywhere along that installed upper rail.

It is a further object of the present invention to provide a sign support anchor which may be placed anywhere along the usable length of that ceiling-attached upper rail.

Yet another object of the present invention is to facilitate the simple use of a pole to reach the upper rail wherein the sign and its anchor may be easily lifted and secured thereto or removed and lowered therefrom.

BRIEF SUMMARY OF THE INVENTION

The present invention comprises a high ceiling sign hanging and support arrangement which includes an elongated upper support rail which is securely attached to the ceiling, for example, by a plurality of securement bolts or studs or the like. An elongated anchor rail, which supports a display sign hanging directly therefrom, is lifted by an elongated lift pole, onto the elongated upper rail for attachment thereto. The elongated anchor rail may have one or more cables or other connection means extending therefrom, the lower end of which are attached to the display sign.

The anchor rail is lifted to and removed from the elongated upper support rail by the lift pole. The lift pole has a main flange on its upper end. The main flange is preferably triangularly shaped. The main flange is attached to the top or head end of the lift pole by the securement of an attachment leg secured to the upper end of the lift pole. A pair of anchor support tabs are preferably arranged on each side of the attachment leg and extend generally perpendicularly away from the main flange.

The upper support rail comprises an elongated extrusion having a generally upside-down or inverted "J" shaped first or front wall and a generally upside-down or inverted "J" shaped rear wall with a first web extending transversely therebetween. The inverted "J" shaped front wall and the inverted "J" shaped rear wall are spaced apart so as to provide an upwardly facing elongated slot or entryway for sliding or pierced receipt of the ceiling stud support member or the like. That ceiling stud support member is thus supportingly enclosed within an upper channel of the upper rail.

A second transverse web preferably extends between the front wall and the rear wall to define a mid-channel between the first transverse web and the second web and the front wall and the rear wall of the upper rail. The front wall has a longitudinally elongated, downwardly directed lower extension member thereon for receipt of the anchor rail thereon. A longitudinally elongated lower leg extends off of the lower edge of the elongated extension member. The lower leg is preferably angled at about 30°, (or may be straight and in-line) with respect to the anchor rail support extension member. A longitudinally elongated support cleat is disposed on the lower edge of the lower leg. This support cleat enables the attachment of the anchor rail to the upper rail.

The anchor rail comprises a longitudinally elongated member, preferably an extrusion, having an upper edge which is bent into a generally "V" shaped lip. This upside-down or inverted "V" shaped lip forms a cleat at the top of the anchor rail. The anchor rail also has a lower edge which defines a lower channel. The lower channel comprises an elongated housing having a downwardly-facing, elongated slot extending along its lowermost side. The lower channel is arranged to slidaby receive a connection means such as for example, a cable head, which head is preferably the uppermost part of a sign support cable or other support means such as a hook or the like. The anchor rail also has an elongated, "pole-receiving" slot through its mid-portion between the upper edge and its lower edge. The elongated pole-receiving slot is arranged to loosely receive the generally triangularly shaped main flange attached to the upper end of the lift pole.

In operation of the sign hanging arrangement, the elongated upper rail is supported along a desired path preferably by attachment to the ceiling by a plurality of upper rail securement devices. Those securement devices each preferably have an enlarged head end which fits within the upper channel of the upper rail. A sign having one or more cables or other connection means attached thereto, is tethered to the elongated anchor rail by the enlarged head of the cables or the other connection means being slid into the lower channel of the anchor rail. The generally triangularly shaped main flange on the upper end of the lift pole is passed through the pole-receiving slot within that anchor rail. The anchor rail is thus lifted upwardly so that the anchor cleat is permitted to be lifted over and set down upon the upper rail support cleat. The main flange of the lift pole may be then withdrawn through the pole-receiving slot and the lift pole removed therefrom. A reverse of that procedure would permit the lifting and removal of that display sign from the elongated upper rail.

The elongated upper rail may be extended (added to) by connecting links secured between adjacent mid-channel portions of to-be-connected adjacent upper rail members.

The upper rail members may in further embodiments comprise a dual support cleat arrangement or single support cleat arrangement along their lower edge thereof.

The invention thus comprises a high ceiling sign hanging arrangement for enabling the attachment and removal of a suspended sign from an extended height, comprising: an elongated upper rail having an upper channel therein for receipt of a ceiling attachment member, the upper rail having an upper rail support cleat, for receipt of a sign bearing anchor rail; an elongated anchor rail for bearing a sign therefrom, the anchor rail comprising an anchor cleat on an upper edge thereon; and a lift means comprising a main flange for mating with the anchor rail and subsequent dis-engagement from the anchor rail upon deposit of the anchor rail on the upper rail support cleat. The lift means preferably comprises an elongated pole having the main flange on an upper end thereof. The anchor cleat of the anchor rail preferably removably rests upon the upper rail support cleat. The anchor rail has a slot therethrough for engaging receipt of the main flange. The upper rail has a mid-channel therethrough for sliding receipt of connecting links between adjacent upper rails adjacently supported from a ceiling.

The invention also may comprise a high ceiling sign hanging arrangement for enabling the attachment and removal of a suspended sign from an extended height, comprising: an elongated upper rail having an upper channel therein for receipt of a ceiling attachment member, the upper rail having an upper rail support cleat, for receipt of a sign bearing anchor rail; an elongated anchor rail for bearing a sign therefrom, the anchor rail comprising an anchor cleat on an upper edge thereon; and a lift means comprising a pole with a main flange on an upper end thereof, to facilitate the mating with the anchor rail and subsequent dis-engagement from the anchor rail upon deposit on the upper rail support cleat of the upper rail. The lift means preferably comprises an elongated pole having the main flange on an upper end thereof. The anchor cleat of the anchor rail preferably removably rests upon the upper rail support cleat on the upper rail. The anchor rail preferably has a slot therethrough for engaging receipt of the main flange. The upper rail preferably has a mid-channel therethrough for sliding receipt of connecting links between adjacent upper rails adjacently supported from a ceiling. The upper rail preferably has an elongated mid-chamber for receipt of connecting links to permit abutting smooth attachment of successive upper rails thereadjacent. The main flange is preferably of generally triangular shape to permit easy mating insertion thereof into the slot of the anchor rail. The elongated anchor rail preferably has an elongated lowermost channel for sliding receipt of connective support members which carry the sign therefrom. The upper rail support foot is angled about 30 degrees from the vertical to permit easy deposit of the cleat of the anchor rail thereon.

The invention may also comprise a method of supporting and changing a display sign from any point in an overhead elongated upper rail attached to a ceiling, comprising one or more of the following steps: connecting the display sign to an elongated anchor rail; piercing a slot arranged in an elongated anchor rail by a main flange attached on the upper end of a lift pole; lifting the anchor rail and the sign thereattached onto a shaped lower edge of an elongated lower extension of the upper rail; depositing the anchor cleat of the anchor rail upon the shaped lower edge of the upper rail; sliding the main flange back out through the slot in the elongated anchor rail; and reversing the process to remove the anchor rail and sign thereattached, from the upper rail; wherein the anchor rail has an inverted "V" shape formed onto its upper edge; wherein the shaped lower edge of the elongated lower extension of the upper rail may be of generally triangular shape in cross-section to provide even support to the inverted "V" shaped cleat of the anchor rail; wherein the elongated lower extension of the upper rail is supported off at an acute angle with respect to the elongated lower extension; wherein the lower extension of the upper rail has a pair of anchor support feet extending downwardly from the elongated lower extension.

The invention may also comprise a high ceiling sign hanging arrangement for enabling the attachment and removal of a suspended sign from an extended height, comprising: an elongated upper rail having an upper channel therein for receipt of a ceiling attachment member, the upper rail having an upper rail support cleat, for receipt of a sign bearing anchor rail; an elongated anchor rail for bearing a sign therefrom, the anchor rail comprising an anchor cleat on an upper edge thereon; a lift means comprising a pole with a main flange on an upper end thereof, to facilitate the mating with the anchor rail and subsequent dis-engagement from the anchor rail upon deposit of the anchor rail support cleat on the upper rail; wherein the lift means comprises an elongated pole having the main flange on an upper end thereof; wherein the anchor cleat of the anchor rail removably rests upon the upper rail support cleat on the upper rail; wherein the anchor rail has a slot therethrough for engaging receipt of the main flange; wherein the upper rail has a mid-channel therethrough for sliding receipt of connecting links between adjacent upper rails adjacently supported from a ceiling; and wherein the upper rail has an elongated mid-chamber for receipt of connecting links to permit abutting smooth attachment of successive upper rails thereadjacent.

BRIEF DESCRIPTION OF THE DRAWINGS

The objects and advantages of the present invention will become more apparent when viewed in conjunction with the following drawings, in which.

DETAILED DESCRIPTION OF THE INVENTION

Figure 1:
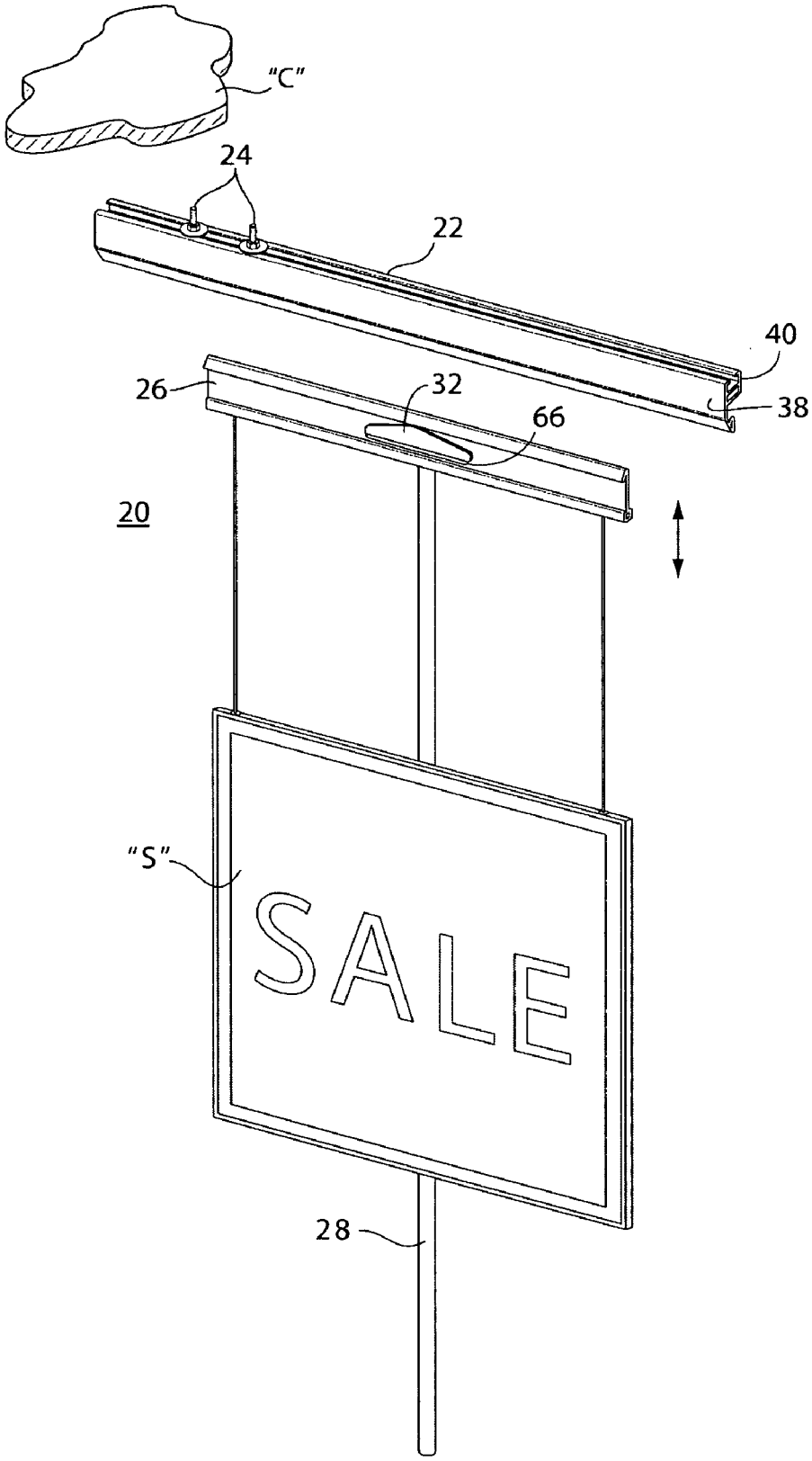
FIG. 1 represents a perspective view of the high ceiling sign hanging arrangement showing an anchor rail in close proximity to an elongated upper rail.
Figure 2:
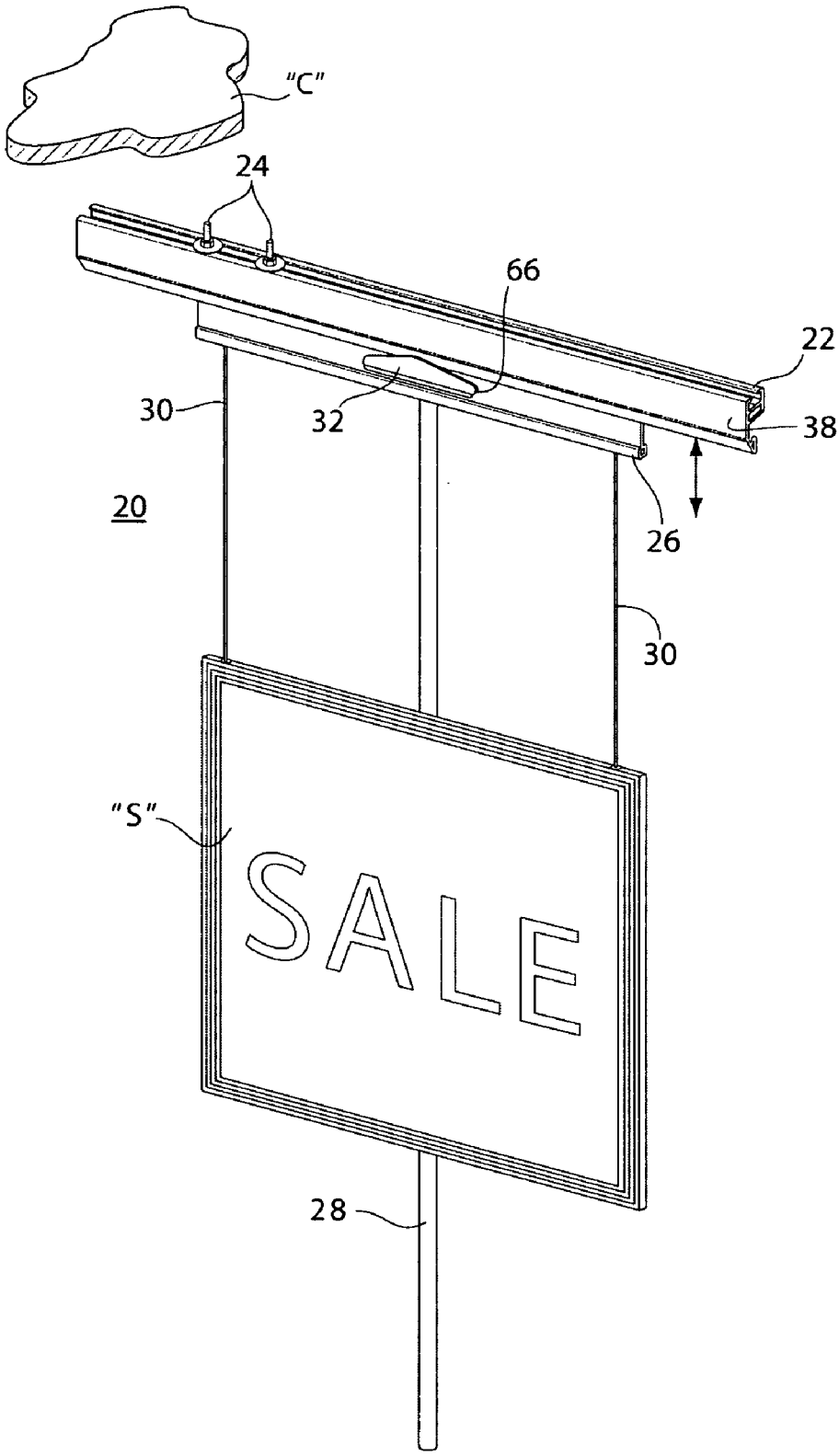
FIG. 2 is a view similar to FIG. 1, showing the anchor rail attached to the elongated upper rail, with a sign hanging from the end portions of the anchor rail.
Figure 3:
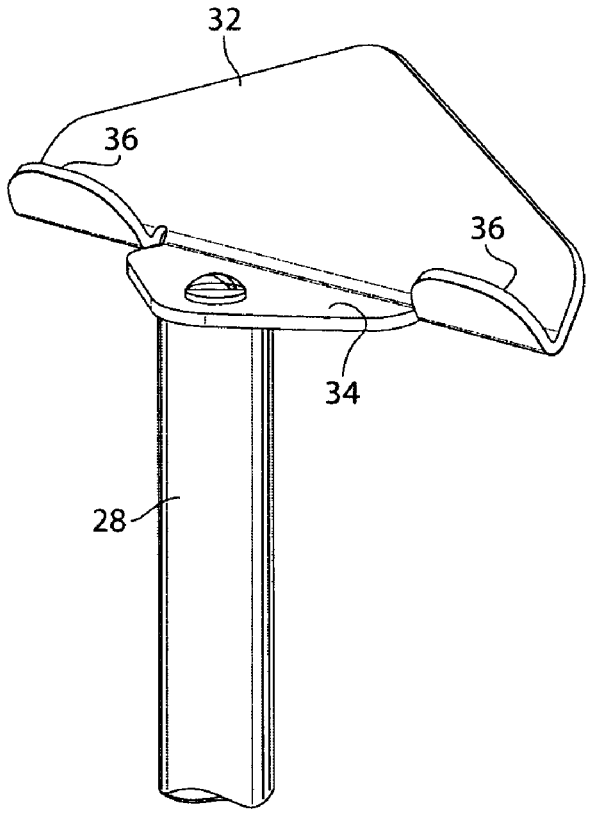
FIG. 3 is a perspective view of a main flange attached to the upper end of a lift pole.
Figure 4:
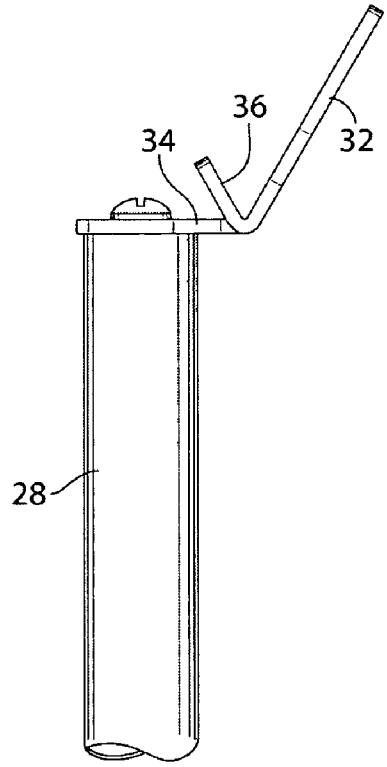
FIG. 4 is an end view of the main flange shown in FIG. 3.
Figure 7:
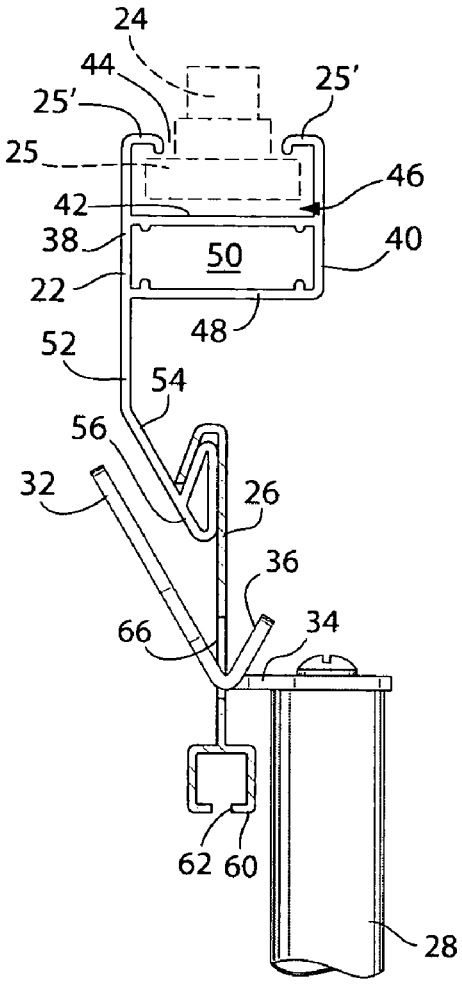
FIG. 7 is a side elevation view showing the upper rail attached to a ceiling by an upper rail support rod with its support rod head end arranged within the upper channel thereof, as well as an anchor rail positioned upon the upper rail support cleat with the lift pole in position and within the anchor slot of the anchor rail.

Referring now to the drawings in detail, and particularly to FIGS. 1 and 2, the present invention is shown, comprising a high ceiling sign hanging arrangement 20, which includes an elongated upper rail 22 which is securely attached to the ceiling "C" by a plurality of securement bolts 24, or studs or the like, best represented in FIG. 7. An elongated anchor rail 26, which supports a display sign "S" shown hanging therefrom, is lifted by an elongated lift pole 28, onto the elongated upper rail 22, for attachment thereto, as represented in FIGS.

1, 2, 7 and 8. The elongated anchor rail 26 may have one or more cables 30 or other connection means extending therefrom, the lower end of which are attached to the display sign "S" as represented in FIGS. 1 and 2, and as shown in phantom, partially, in FIG. 6.

The anchor rail 26 is lifted to and removed from the elongated upper rail 22 by the lift pole 28. The lift pole 28 has a generally triangularly shaped main flange 32 on its upper or head end, as represented in FIGS. 1, 2, 3, 4, 7 and 8. The main flange 32 is attached to the top of the lift pole 28 by the securement of an attachment leg 34 secured to the upper end of the lift pole 28. A pair of anchor support tabs 36 are arranged on either side of the attachment leg 34, at the base of and at about an acute angle with respect to the triangularly shaped main flange 32, and they also extend generally almost perpendicularly away from the main flange 32, as best represented in FIGS. 3, 4, 7 and 8.

Figure 5:
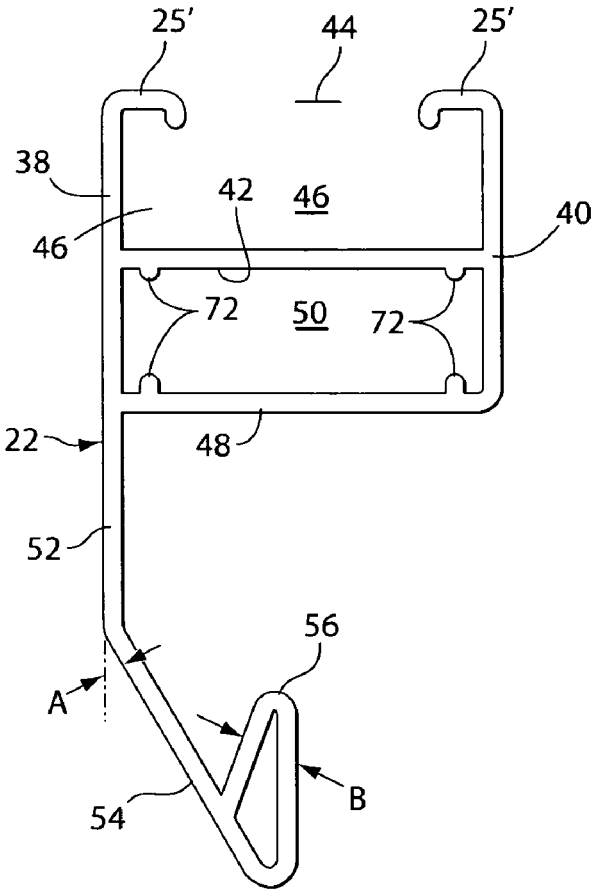
FIG. 5 is an end view of a first preferred embodiment of an elongated upper rail.

As is shown in FIG. 5, the upper rail 22 comprises an elongated extrusion having a generally upside-down "J" shaped first or front wall 38 and a generally upside-down "J" shaped rear wall 40 with a first web 42 extending transversely therebetween. The upside-down "J" shaped front wall 38 and the upside-down "J" shaped rear wall 40 are spaced apart so as to provide an upwardly facing elongated slot or entryway 44 with "lips" 25' for receipt of the ceiling stud support member(s) 24, or the like, as best shown by phantom lines in FIG. 7. That ceiling stud support 24 has a head 25 which is thus supportingly enclosed within the upper channel 46 of the upper rail 22, by the lips 25'.

Figure 8:
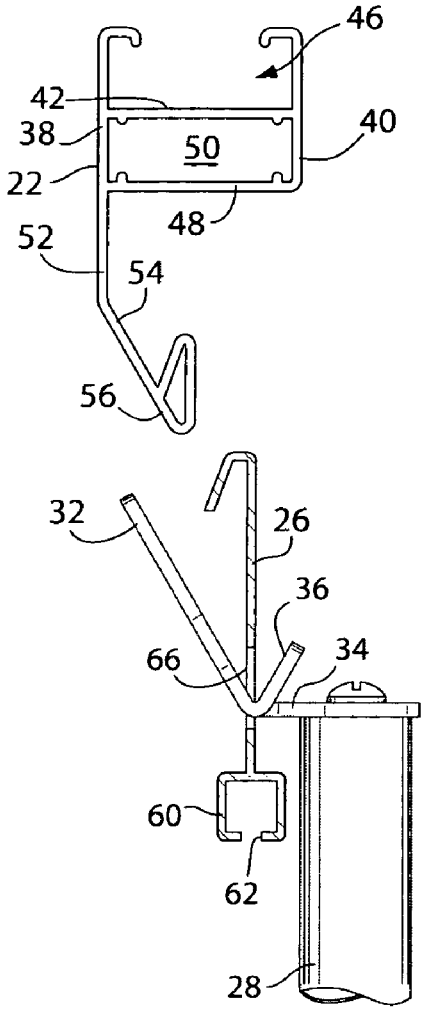
FIG. 8 is a side elevational view of the upper rail, the anchor rail and the main flange, which main flange has been passed through the slot in the anchor rail, which has been lifted into close proximity to the upper rail.

A second web 48 extends transversely between the front wall 38 and the rear wall 40 to define a "connecting-link" for creating a mid-channel 50 between the first web 42 and the second web 48 and the front wall 38 and the rear wall 40 of the upper rail 22, as is shown in FIGS. 5, 7 and 8. The front wall 38 of the upper rail 22, has a longitudinally elongated lower wall extension 52 thereon for receptive support of the anchor rail 26, identified more precisely hereinbelow. A longitudinally extending lower wall or leg 54 extends off of the lower edge of the wall extension 52, as shown in FIGS. 5, 7 and 8. The lower wall or leg 54 is preferably arranged at an angled at about 30° with respect to the anchor rail support wall extension 52, but in a further embodiment, may be in straight alignment therewith. An elongated upper rail cleat 56, for support of the anchor rail 26, is disposed on the lower edge of the lower wall or leg 54. The support cleat 56 is preferably of triangular "shape" in cross-section, as may be seen in FIGS. 5 and 8. This "shaped" support cleat 56 permits snug, non-swinging, supportive, deposited attachment of the anchor rail 26 to the upper rail 22.

Figure 6:
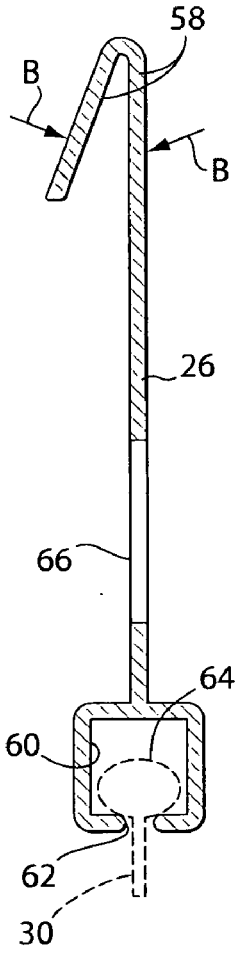
FIG. 6 is an end view of a preferred embodiment of the elongated anchor rail.

The anchor rail 26 comprises an elongated member having an upper edge 58 which is bent into a generally "V" shaped lip thereon, as shown in FIGS. 6, 7 and 8. This upside-down "V" shaped lip forms the cleat at the top of the anchor rail 26. The anchor rail 26 also has a lower edge which defines a lower channel 60. The lower channel 60 comprises an elongated housing having a downwardly-facing, elongated slot 62 extending along its lowermost side. The lower channel 60 is arranged to slidaby receive a connection means such as for example, a cable head 64, which head is preferably the uppermost part of a sign support cable 30, or other support means, for example, hooks or the like, which is represented in phantom in FIG. 6. The anchor rail 26 also has an elongated, "pole-receiving" slot 66 through its mid-portion between the upper edge and its lower edge, as represented in FIGS. 1, 2, 7 and 8. The elongated pole-receiving slot 66 is arranged to loosely receive the generally triangularly shaped main flange 32 attached to the upper end of the lift pole 28, as best represented in FIGS. 7 and 8.

Figure 11:
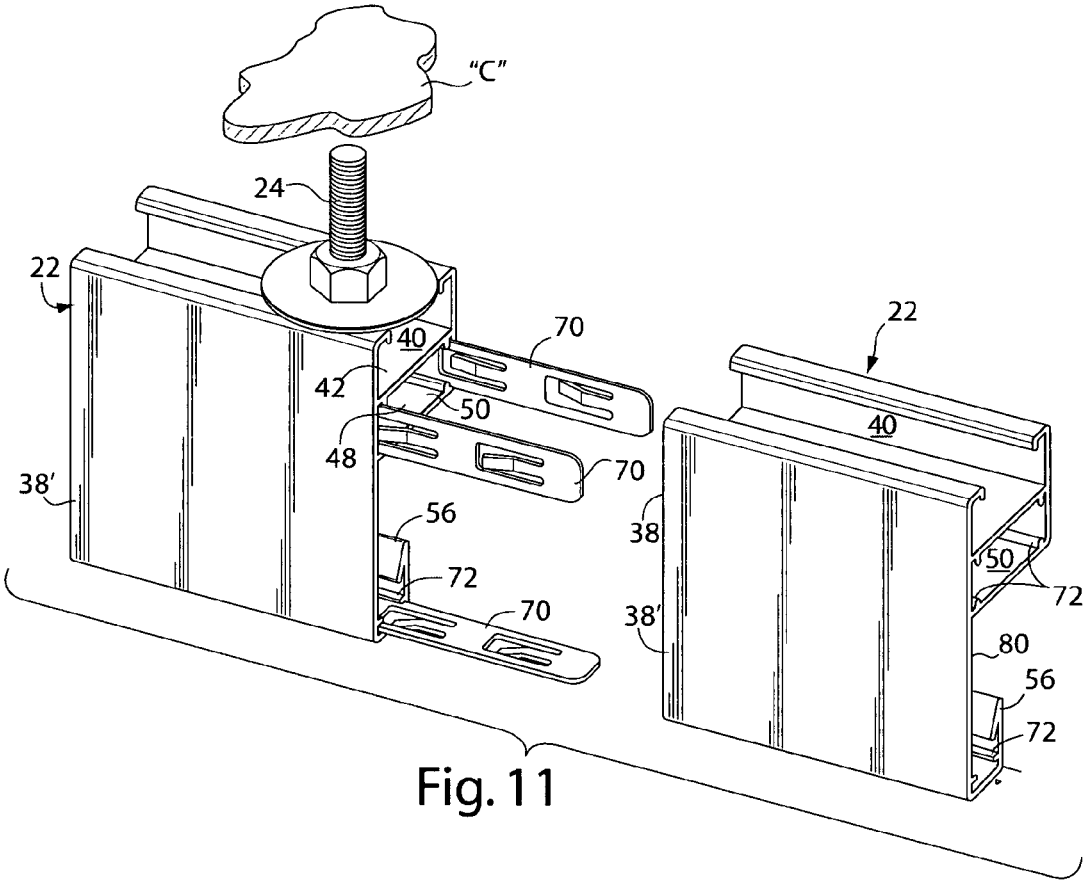
FIG. 11 is a perspective view of a pair of upper rail members in a slightly spaced-apart configuration, with a plurality of connecting links arranged within the mid-channel and the upper rail support foot of one upper rail, for secured engagement to an adjacent upper rail.

In operation of the sign hanging arrangement 10, the elongated upper rail 22 is supported along a desired path preferably by attachment to the ceiling "C" by a plurality of upper rail securement devices 24, as represented in FIGS. 7 and 11. Those securement devices 24 each preferably have an enlarged head end 25 which fits within the upper channel 46 of the upper rail 22. A sign "S" having one or more cables 30 or other connection means attached thereto, is tethered to the elongated anchor rail 26 by the enlarged head 25 of the cables 30, or other connection means, being slid into the lower channel 60 of the anchor rail 26, as represented in FIG. 6. The main flange 32 on the upper end of the lift pole 28 is passed through the pole-receiving slot 66 within that anchor rail 26. The anchor rail 26 may thus be lifted upwardly so that the anchor cleat 58 is permitted to be lifted over and set down upon the upper or anchor rail support cleat 56, as best represented in FIG. 7. The main flange 32 may be then withdrawn through the pole-receiving slot 66 and the lift pole 28 removed therefrom. A reverse of that procedure would permit the lifting of the anchor rail 26, and hence the subsequent removal of that display sign "S" from the elongated upper rail 22.

The elongated upper rail may be extended (added to) by connecting links 70 secured between adjacent mid-channel portions of to-be-connected adjacent upper rail members 22. The mid channel 50 of each upper rail 22 has alignment tabs 72, for guided receipt of the connecting links 70, as represented in FIG. 11.

Figure 9:
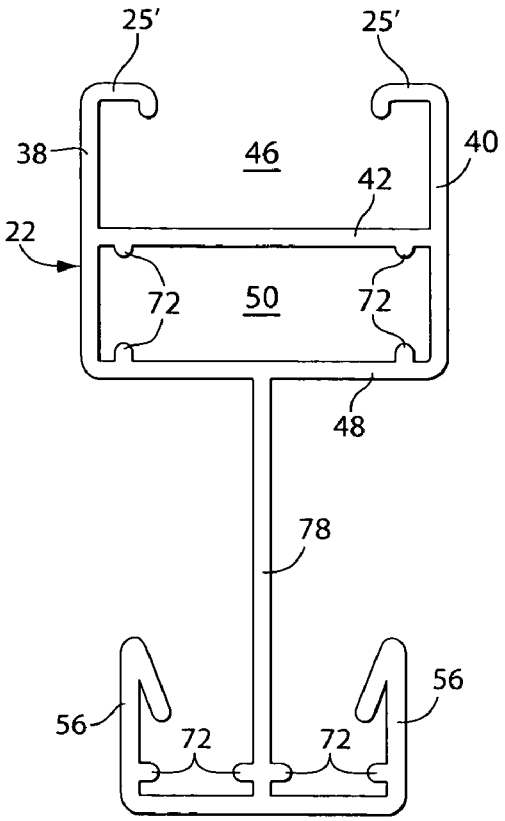
FIG. 9 is an end to view of a further embodiment of the upper rail having a dual support cleat arranged along its lower edge thereof.
Figure 10:
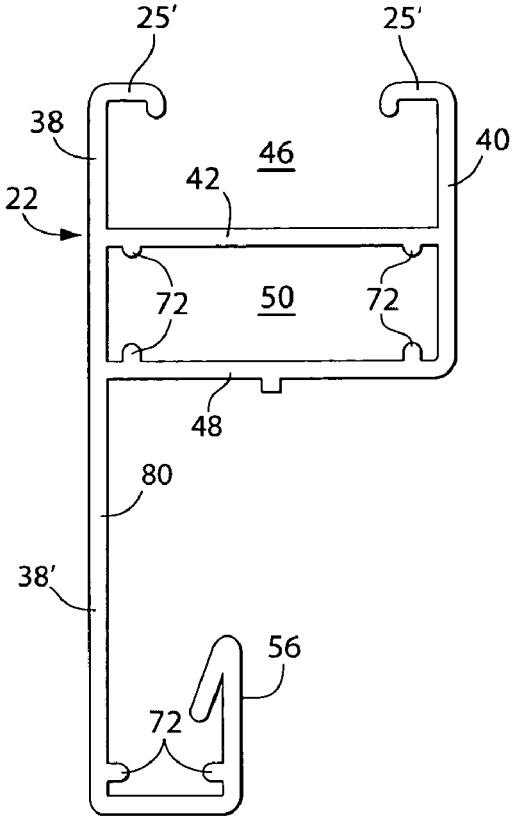
FIG. 10 is an end view of an upper rail with a single support cleat arrangement extending along a lower end thereof.

The upper rail members 22 may in further embodiments comprise a dual support cleat arrangement 78, as represented in FIG. 9 or a single support cleat arrangement 80, as represented in FIG. 10, each located along their lower edge thereof.

The invention claimed is:

1. A method of supporting and changing a display sign from any point in an overhead elongated upper rail attached to a ceiling, comprising:

connecting the display sign to an elongated anchor rail;

piercing a slot arranged in an elongated anchor rail by an angled main flange attached on an upper end of a lift pole;

lifting the anchor rail and the sign thereattached onto a shaped lower edge of an elongated lower extension of the upper rail;

depositing an anchor cleat of the anchor rail upon the shaped lower edge of the upper rail;

sliding the angled main flange back out through the slot in the elongated anchor rail; and reversing the process to remove the anchor rail and sign thereattached, from the upper rail, wherein the anchor rail is of inverted "V" shape in cross-section form on its upper edge, and wherein the shaped lower edge of the elongated lower extension of the upper rail is of generally triangular shape in cross-section to provide even support to the cleat of the anchor rail, and wherein the elongated lower extension of the upper rail is supported off at an acute angle with respect to the elongated lower extension.

2. The method as recited in claim 1, wherein the elongated lower extension of the upper rail is supported off at an acute angle with respect to the elongated lower extension.

3. The method as recited in claim 1, wherein the lower extension of the upper rail has a pair of anchor support feet extending downwardly from the elongated lower extension.

4. A method of supporting and changing a display sign from any point in an overhead elongated upper rail attached to a ceiling by a high ceiling hanging arrangement, the method comprising:

connecting the display sign to an elongated anchor rail;

piercing a slot arranged in an elongated anchor rail by an angled main flange attached on an upper end of a lift pole;

lifting the anchor rail and the sign thereattached onto a shaped lower edge of an elongated lower extension of the upper rail;

depositing an anchor cleat of the anchor rail upon the shaped lower edge of the upper rail;

sliding the angled main flange back out through the slot in the elongated anchor rail; and reversing the process to remove the anchor rail and sign thereattached, from the upper rail, wherein the anchor rail is of inverted "V" shape in cross-section form on its upper edge, and wherein the shaped lower edge of the elongated lower extension of the upper rail is of generally triangular shape in cross-section to provide even support to the cleat of the anchor rail, and wherein the elongated lower extension of the upper rail is supported off at an acute angle with respect to the elongated lower extension, wherein the high ceiling sign hanging arrangement for enabling the attachment and removal of a suspended sign from an extended height, comprises:

the elongated upper rail having the lipped upper channel therein for receipt of the ceiling attachment member, the upper rail having the generally triangularly cross-section shaped upper rail support cleat, for non-swinging receipt of the sign bearing elongated anchor rail;

the elongated anchor rail for bearing a sign therefrom, the anchor rail having the anchor cleat of "V" shape in cross-section on the upper edge thereon for stable support with the support cleat;

a lift means comprising the pole with a main flange on an upper end thereof, to facilitate the mating with the anchor rail and subsequent dis-engagement from the anchor rail upon deposit of the anchor cleat on the upper rail; and wherein the lift means comprises the elongated pole having the triangularly shaped flange on the upper end thereof.

5. The high ceiling sign hanging arrangement as recited in claim 4, wherein the anchor cleat of the anchor rail removably rests upon the upper rail support cleat on the upper rail, the anchor rail having a slot therethrough for engaging receipt of the flange, the upper rail having a mid-channel therethrough for sliding receipt of connecting links between adjacent upper rails adjacently supported from a ceiling; and wherein the upper rail has an elongated mid-chamber for receipt of connecting links to permit abutting the smooth attachment of successive upper rails thereadjacent.

* * * * *